US011664178B2

(12) United States Patent
Ni

(10) Patent No.: US 11,664,178 B2
(45) Date of Patent: May 30, 2023

(54) DUAL LOAD DIMMER SWITCH WITH VERTICAL SLIDER CONTROLS FOR FAN SPEED AND LIGHTING INTENSITY

(71) Applicant: Enerlites Inc., Irvine, CA (US)

(72) Inventor: Lidong Ni, Zhejiang (CN)

(73) Assignee: ENERLITES INC., Irvine, CA (US)

( * ) Notice: Subject to any disclaimer, the term of this patent is extended or adjusted under 35 U.S.C. 154(b) by 0 days.

(21) Appl. No.: 17/500,065

(22) Filed: Oct. 13, 2021

(65) Prior Publication Data

US 2022/0208485 A1 Jun. 30, 2022

(30) Foreign Application Priority Data

Dec. 24, 2020 (CN) ..... 202023165059.6

(51) Int. Cl.

| | |
|---|---|
| ***H01H 15/10*** | (2006.01) |
| ***H01H 3/12*** | (2006.01) |
| ***H01H 3/40*** | (2006.01) |
| ***H01H 3/04*** | (2006.01) |
| ***H01H 15/08*** | (2006.01) |
| ***H01H 3/02*** | (2006.01) |
| *F21V 23/04* | (2006.01) |
| *F21V 33/00* | (2006.01) |

(52) U.S. Cl.

CPC ..... *H01H 15/10* (2013.01); *H01H 3/0253* (2013.01); *H01H 3/04* (2013.01); *H01H 3/12* (2013.01); *H01H 3/40* (2013.01); *H01H 15/08* (2013.01); *F21V 23/04* (2013.01); *F21V 33/0096* (2013.01)

(58) Field of Classification Search

CPC ..... H01H 15/00; H01H 3/0253; H01H 3/04; H01H 3/12; H01H 3/40; H01H 15/24; H01H 1/36

USPC ..... 200/52 R

See application file for complete search history.

(56) References Cited

U.S. PATENT DOCUMENTS

| | | | | |
|---|---|---|---|---|
| 5,051,549 A * | 9/1991 | Takano | ..... | H01H 15/04 200/549 |
| 5,598,917 A * | 2/1997 | Thomas | ..... | H01H 19/11 200/503 |
| 5,959,525 A * | 9/1999 | Black | ..... | H01C 10/50 338/200 |

* cited by examiner

*Primary Examiner* — Edwin A. Leon
*Assistant Examiner* — Iman Malakooti
(74) *Attorney, Agent, or Firm* — Ziegler IP Law Group LLC

(57) ABSTRACT

A gear structure and a dimmer and speed control switch, wherein the gear structure includes a plurality of positioning grooves and a gear switching component, and the plurality of positioning grooves are sequentially spaced apart on the housing; the gear switching component is movably Installed on the housing, it includes a positioning component and a biasing component connected with the positioning component. The positioning component has a first position that is positioned and matched with the positioning groove and a second position separated from the positioning groove. The biasing component applies a biasing force on position component that moves it toward the first position, the gear structure mentioned above can ensure accurate gear positioning during the operation of the dimmer and speed control switch, and is not prone to misoperate, which is convenient for users, and coordinated positioning grooves and positioning parts have the advantage of simplified structure.

12 Claims, 11 Drawing Sheets

DUAL LOAD DIMMER SWITCH WITH VERTICAL SLIDER CONTROLS FOR FAN SPEED AND LIGHTING INTENSITY

TECHNICAL FIELD

The aspects of the disclosed embodiments relate to the technical field of switches, to a gear assembly and structure for a dimmer and speed control switch.

TECHNICAL BACKGROUND

A dimmer and fan speed control switch is often seen in our daily lives. It can be used to adjust the brightness of a light, and it can also be used to adjust the speed of a fan.

The gear switching mechanism of the dimmer and fan speed control switch mainly includes a push button component, a moving contact, and multiple sets of static contact components. The push button component can be installed parallel on the housing, and the moving contact is installed on the push button component. The multiple sets of static contact components are arranged at intervals along the moving direction of the push button component. The user drives the push button component to move, thereby driving the movable contact to contact with different static contact components to switch between different gears. At present, the gear position of the dimmer and speed control switch is inaccurate, that is, the push button component can be driven under a small external force, which is prone to incorrect operation and affects the user's experience. In addition, since the moving contact follows the push button component which moves in a parallel fashion, in order to ensure that the moving contact will not be in contact with the next static contact component when it is not completely separated from the previous static contact component, a larger space must be maintained between two adjacent static contact components. When there are more sets of static contact components, the switch will have a larger volume.

SUMMARY

Therefore, the technical problem to be solved by the aspects of the disclosed embodiments is to overcome the shortcomings of inaccurate gears, thereby providing a structure with accurate gears, and a dimmer and speed control switch with a gear structure.

For this reason, the aspects of the disclosed embodiments provide a gear structure, which includes a plurality of positioning grooves and gears for switching components. The plurality of positioning grooves is sequentially spaced apart on the housing. The movable gear switch component is installed on the housing and includes a positioning component and a biasing component connected to it; the positioning component has a first position that is positioned to match with the positioning groove; and a second position that is separated from the positioning groove. The biasing component applies a biasing force to the positioning component to move it toward the first position.

The positioning component is a roller, and when in the first position, part of the roller can extend into the positioning groove.

The first opening of the positioning groove is provided with an inclined surface or an arc surface which can contact the roller.

The gear switching component includes a roller and a mounting seat. The roller is provided with a connecting shaft in the middle; the bottom of the mounting seat is provided with two mounting plates arranged oppositely for the roller to be mounted between. The mounting plate is provided with the first elongated hole which can extend the connecting shaft and limit its moving track.

The first elongated hole is provided with a second opening, and the diameter of the second opening is smaller than the diameter of the connecting shaft.

The housing is provided with sets of static contact components arranged at intervals along the moving direction of the gear switching component, and each set of static contact components includes two static contacts arranged separately on either side of the moving direction of the gear switching component. The connecting shaft is a metal shaft; in the first position, both ends of the connecting shaft are in contact with the corresponding static contacts, respectively.

The biasing component includes a main shrapnel and two elastic arms. The main shrapnel is fixed on the mounting seat; the two elastic arms are separately arranged on either side of the main shrapnel and are connected at the bend. The two elastic arms contact with the two ends of the connecting shaft.

The gear switching component further includes a push button that is provided on the mounting seat and can be linked with it. The push button is connected to the housing through a slide rail structure, and the slide rail structure includes a sliding groove on the inner side of the housing, and at least one sliding block arranged on one side of the push button to be connected by a slide with the sliding groove.

The push button is hooked and connected to the housing through an elastic hook structure. The elastic hook structure includes a second elongated hole and at least one elastic hook. The second elongated hole is provided on the top surface of the housing, and the extension direction of the second elongated hole is arranged parallel to the moving direction of the push button. At least one elastic hook is arranged on the other side of the push button, and the elastic hook can be hooked with the housing after passing through the second elongated hole.

The aspects of the disclosed embodiments also provide a dimmer and speed control switch, which includes the gear structure mentioned above.

The technical proposal of the aspects of the disclosed embodiments has the following advantages:

1. The gear structure provided by the aspects of the disclosed embodiments includes a plurality of positioning grooves and gears for switching components. The plurality of positioning grooves is sequentially spaced apart on the housing; the movable gear switch component is installed on the housing and includes a positioning component and a connected biasing component. The positioning component has a first position that is positioned and matched with the positioning groove and a second position that is separated from the positioning groove. The biasing component applies a biasing force to the positioning component to move it toward the first position. The gear structure mentioned above can ensure accurate gear positioning during operation of the dimmer and speed control switch, and is not prone to incorrect operation, which is convenient for users. The cooperated positioning grooves and positioning parts simplify the structure.

2. In the gear structure provided by the aspects of the disclosed embodiments, the positioning component is a roller, and when in the first position, part of the roller can extend into the positioning groove, and the roller can reduce the abrasion between the positioning groove, prolonging service life.

3. In the gear structure provided by the aspects of the disclosed embodiments, the first opening of the positioning groove is provided with an inclined surface or an arc surface which can contact the roller. The inclined surface increases the aperture of the positioning groove, and the steps where the inclined plane is located can better limit and block the rollers.

4. In the gear structure provided by the aspects of the disclosed embodiments, the first elongated hole is provided with a second opening, and the diameter of the second opening is smaller than the diameter of the connecting shaft. This prevents the connecting shaft from detaching from the mounting plate, which would otherwise cause the mounting plate to fail to drive the connecting shaft to shift gears.

5. The housing is provided with a plurality of sets of static contact components arranged at intervals along the moving direction of the gear switching component, and each set of static contact components includes two static contacts separately arranged on both sides of the moving direction of the gear switching component. The connecting shaft is a metal shaft; in the first position, both ends of the connecting shaft are in contact with the corresponding static contacts, respectively. The connecting shaft is used as a connecting component between the roller and the mounting seat, and on the other hand, the connecting shaft is used as a "moving contact", which can connect two static contacts in contact, that is, one connecting shaft can meet two use functions, so there are fewer parts, a simpler structure, and lower production costs. In addition, when shifting, because the connecting shaft can follow the roller to move diagonally upwards relative to the static contact, part or all of the connecting shaft is still located above the previous static contact component when the connecting shaft is separated from the previous static contact component. Compared with the current technology in which the moving contact follows the push button to move in parallel and needs to move completely to the position between the two static contact components in order to separate from the previous static contact component, the distance between two adjacent static contact components can be set smaller and the switch can be designed to be more compact in this proposal.

6. In the gear structure provided by the aspects of the disclosed embodiments, the gear switching component further includes a push button which is arranged on the mounting seat and can be linked with it. The push button is connected by sliding into the housing through a slide rail structure, and the slide rail structure includes a sliding groove on the inner side of the housing, and at least one sliding block arranged on one side of the push button to be connected by slider the sliding groove. The sliding rail structure can greatly reduce the friction between the push button and the housing during the operation of the dimmer and speed control switch, and there is an advantage of simplified structure between the matched sliding groove and the sliding block.

7. In the gear structure provided by the aspects of the disclosed embodiments, the push button is hooked and connected with the housing through an elastic hook structure. The elastic hook structure includes a second elongated hole and at least one elastic hook. The second elongated hole is provided on the top surface of the housing. The extension direction of the second elongated hole is arranged parallel to the moving direction of the push button; at least one elastic hook is arranged on the other side of the push button, and the elastic hook can be hooked to the housing after passing through the second elongated hole. The elastic hook structure can strengthen the connection between the push button and the housing and prevent the push button from detaching.

BRIEF DESCRIPTION OF THE DRAWINGS

In order to clearly illustrate the specific embodiments of the present disclosure or the technical solutions according to the aspects of the disclosed embodiments, a brief introduction of the drawings that must be used in the specific embodiments or the proposal are as follows. The drawings are some embodiments of the present disclosure. For general technicians in this field, other drawings can be obtained from these drawings without creative work.

Figure 1:
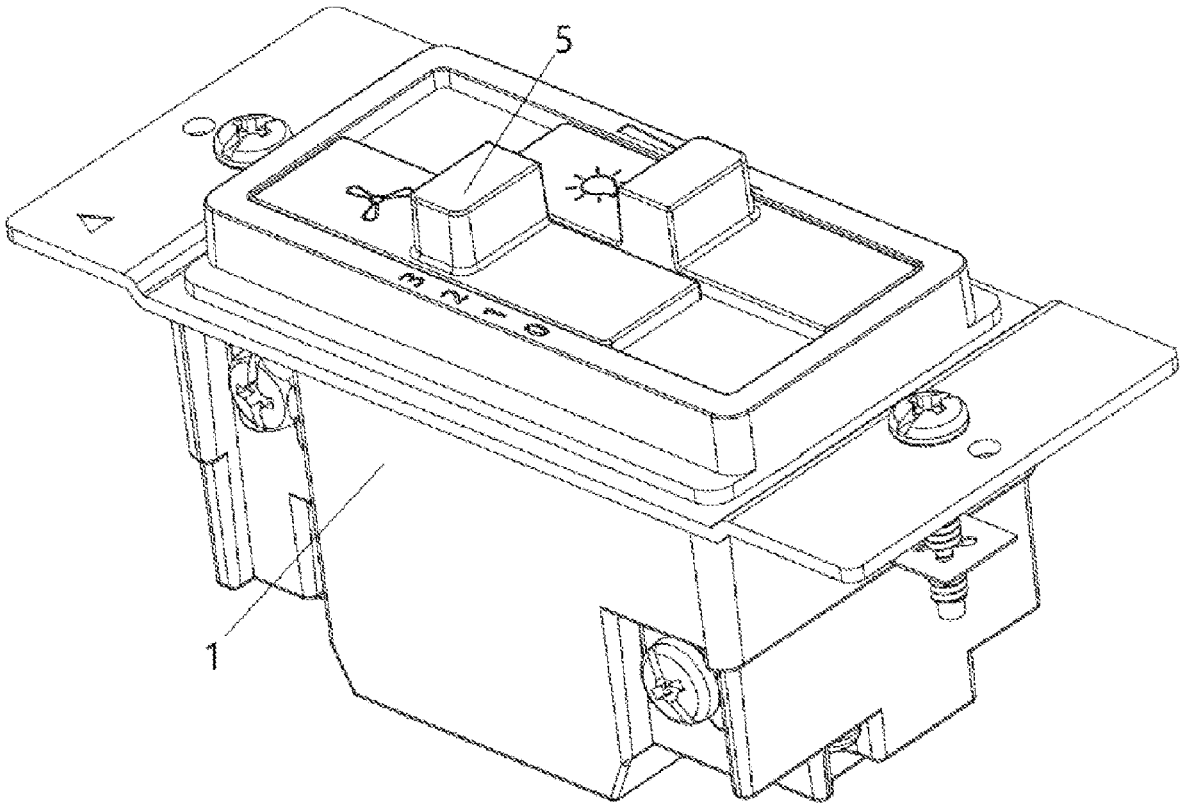
FIG. 1 is a three-dimensional view of the dimmer and speed control switch incorporating aspects of the disclosed embodiments.

Description of reference signs: 1, housing; 11, positioning groove; 12, inclined surface; 13, static contact; 14, sliding groove; 15, second elongated hole; 2, biasing component; 21, main shrapnel; 22, elastic arm; 3, roller; 31, connecting shaft; 32, side plate; 4, mounting seat; 41, mounting plate; 42, first elongated hole; 43, second opening; 5, push button; 51, slide block; 52, elastic hook.

DETAILED DESCRIPTION OF EMBODIMENTS

The technical solution of the present disclosure will be described clearly and completely below in conjunction with the accompanying drawings. Obviously, the described embodiments are only part but not all of the embodiments of the present disclosure. Based on the embodiments of the present disclosure, all other embodiments obtained by those general technicians in this field without creative work shall fall within the protection range of the present utility.

In the description of the present disclosure, it should be noted that the indication terms "center," "upper," "lower," "left," "right," "vertical," "horizontal," "inner," "outer" are based on the orientation or positional relationship shown in the drawings, and are only for the convenience of describing the utility and simplifying the description, rather than indicating or implying that the pointed device or element must have a specific orientation or be constructed and operated in a specific orientation, and therefore should not be understood as a limitation of the present utility. In addition, the terms "first", "second", and "third" are only used for descriptive purposes and should not be understood as indicating or implying relative importance.

In the description of the present disclosure, it should be noted that unless there are another clear regulations and limitations, the terms "installation," "connected," and "linked" should be interpreted in a broad sense. For example, it can be fixed connection, detachable connection, or integral connection; it can be a mechanical connection or an electrical connection; it can be directly connected, or indirectly connected through an intermediate medium, and it can be the internal connection between two components. For those general technicians in this field, the specific meaning of the terms mentioned above in the present utility can be understood under specific circumstances.

In addition, the technical features involved in the different embodiments of the present disclosure described below can be combined with each other if they do not conflict with each other.

EMBODIMENTS

Figure 2:
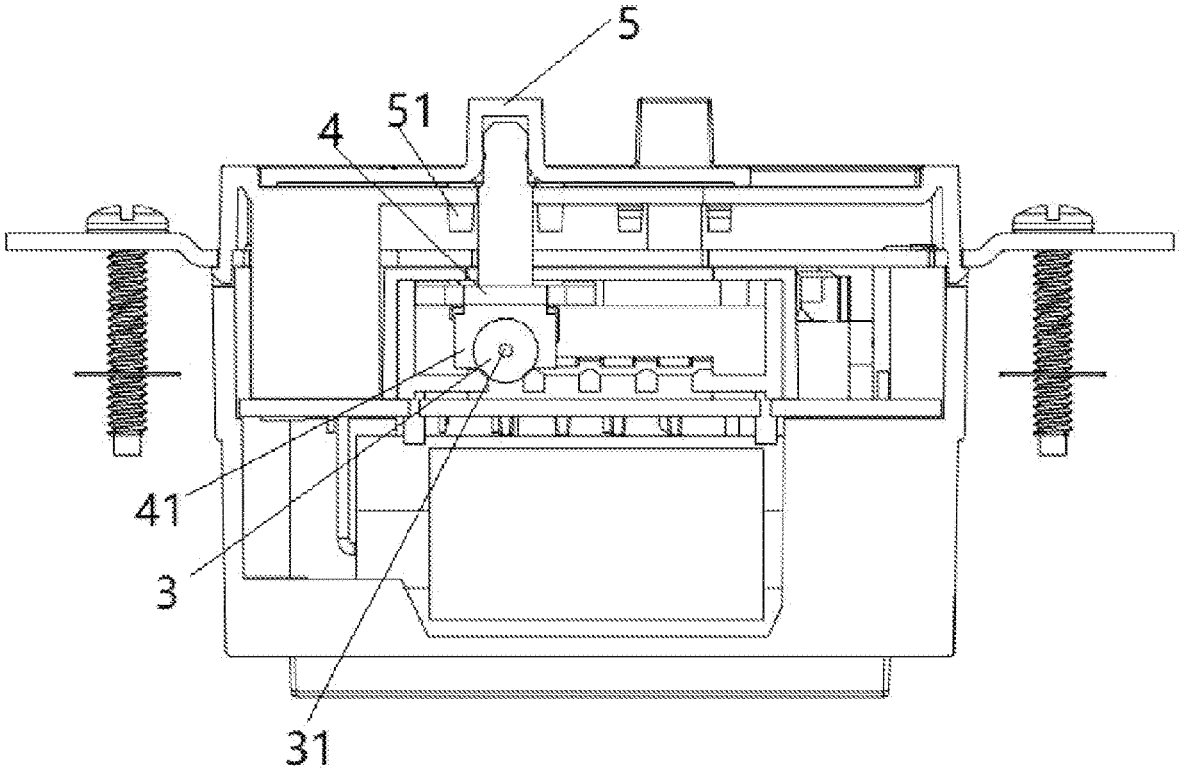
FIG. 2 is a cross-sectional view of FIG. 1.
Figure 3:
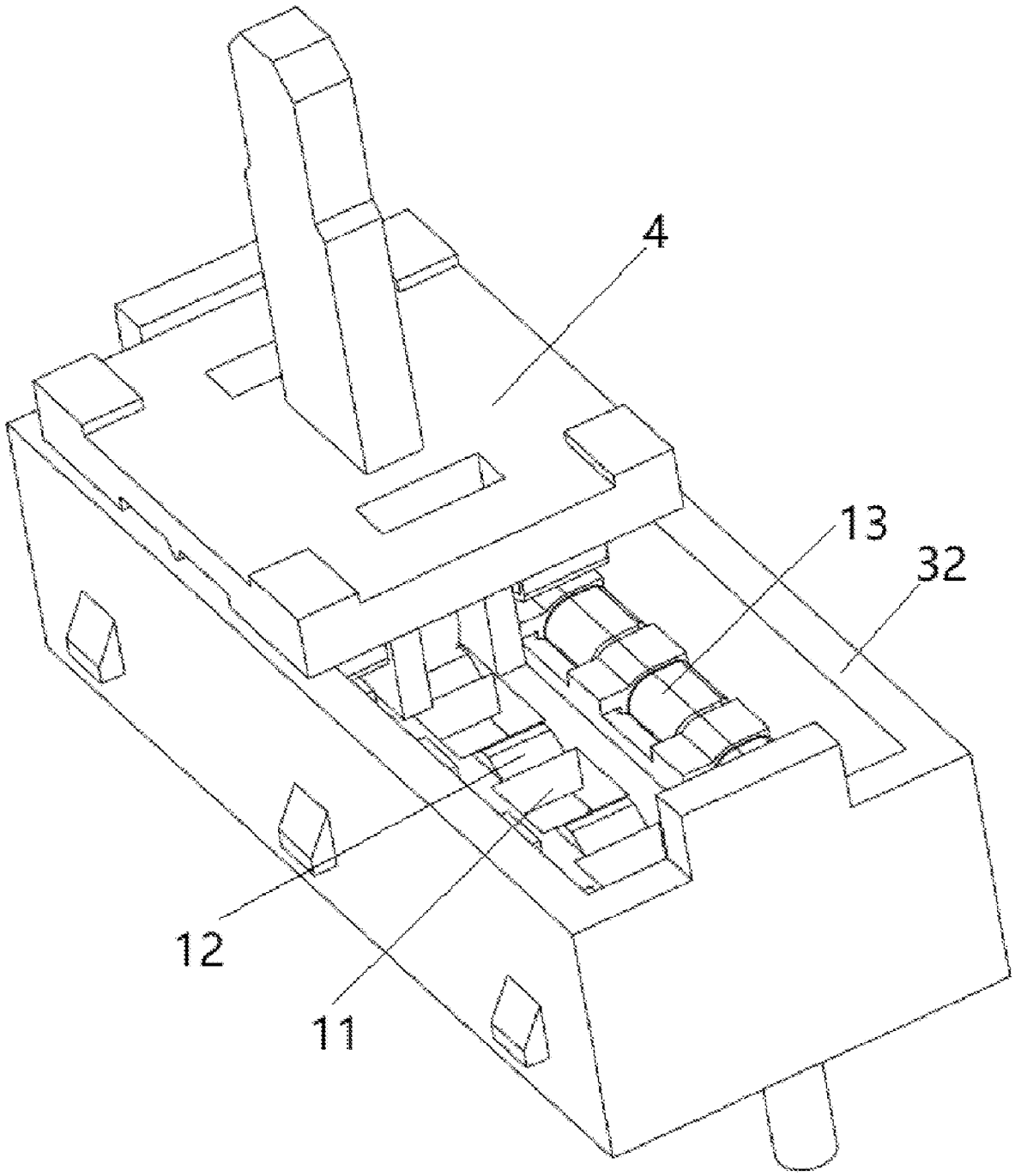
FIG. 3 is a perspective view of the gear structure.

The aspects of the disclosed embodiments provide a dimmer and speed control switch, which includes a gear structure. As shown in FIGS. 1 and 2, the gear structure includes a housing 1 and a gear switching component.

Figure 4:
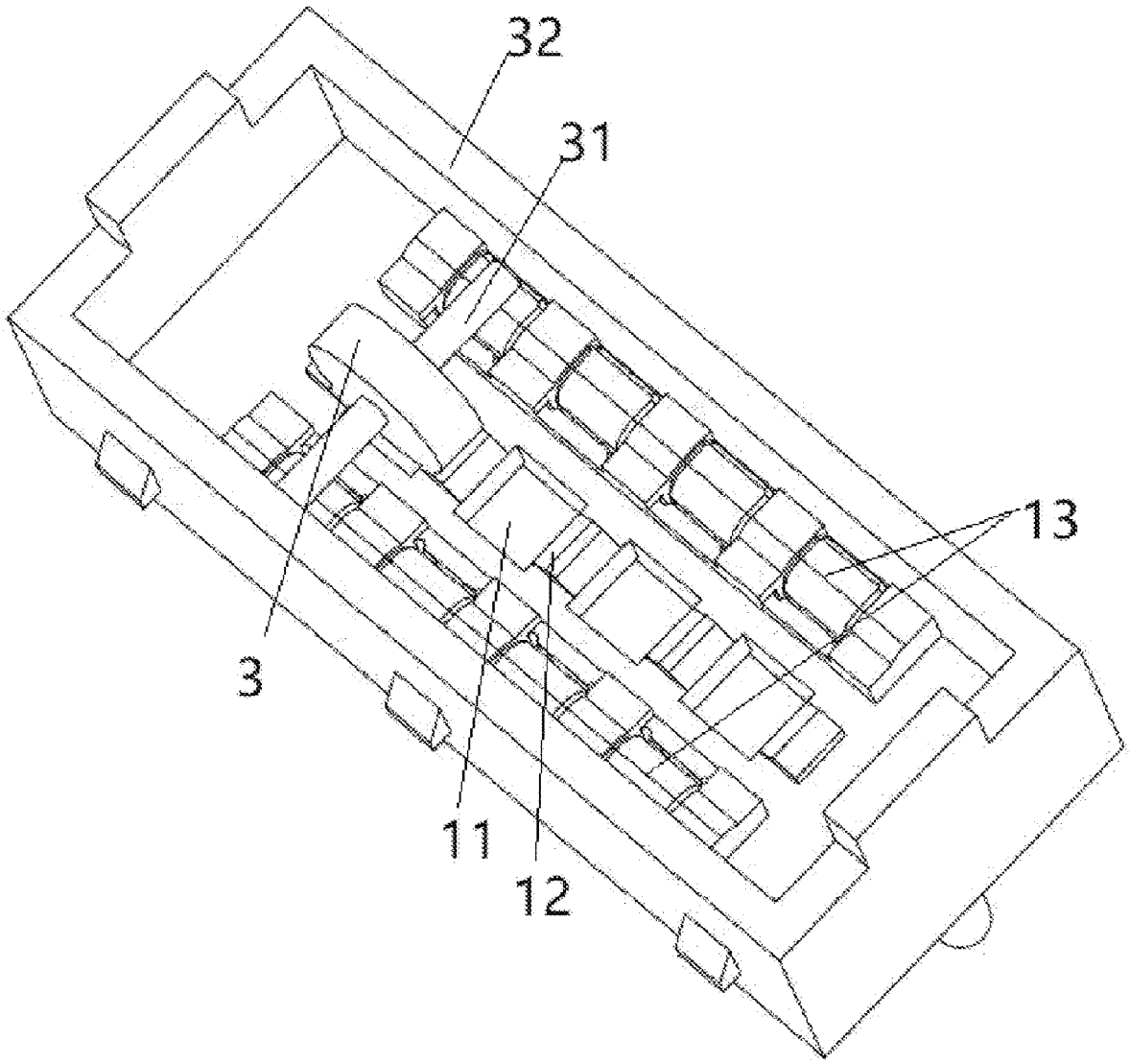
FIG. 4 is a perspective view of FIG. 3 with the mounting seat and biasing component removed.
Figure 6:
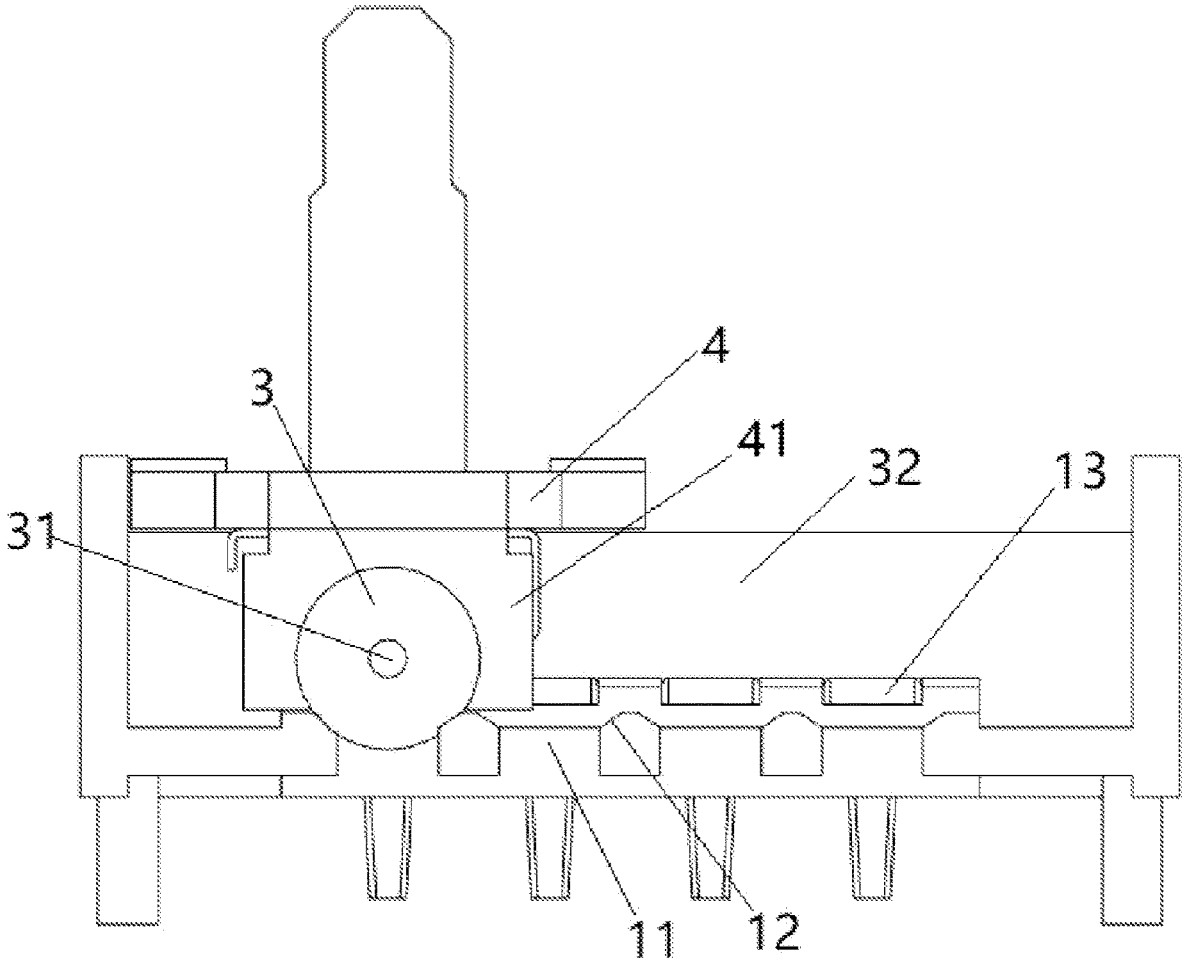
FIG. 6 is a cross-sectional view of FIG. 3.

The housing 1, as shown in FIGS. 1, 2, 6 and 11, has positioning grooves 11 arranged at intervals from left to right. As shown in FIGS. 4 and 6, the first opening of positioning groove 11 is provided with an inclined surface 12 that can contact the roller 3. Housing 1 is provided with four sets of static contact components spaced apart along the moving direction of the gear switching component. Each set of static contact components includes two static contacts 13 arranged on either side of the moving direction of the gear switching component.

Figure 11:
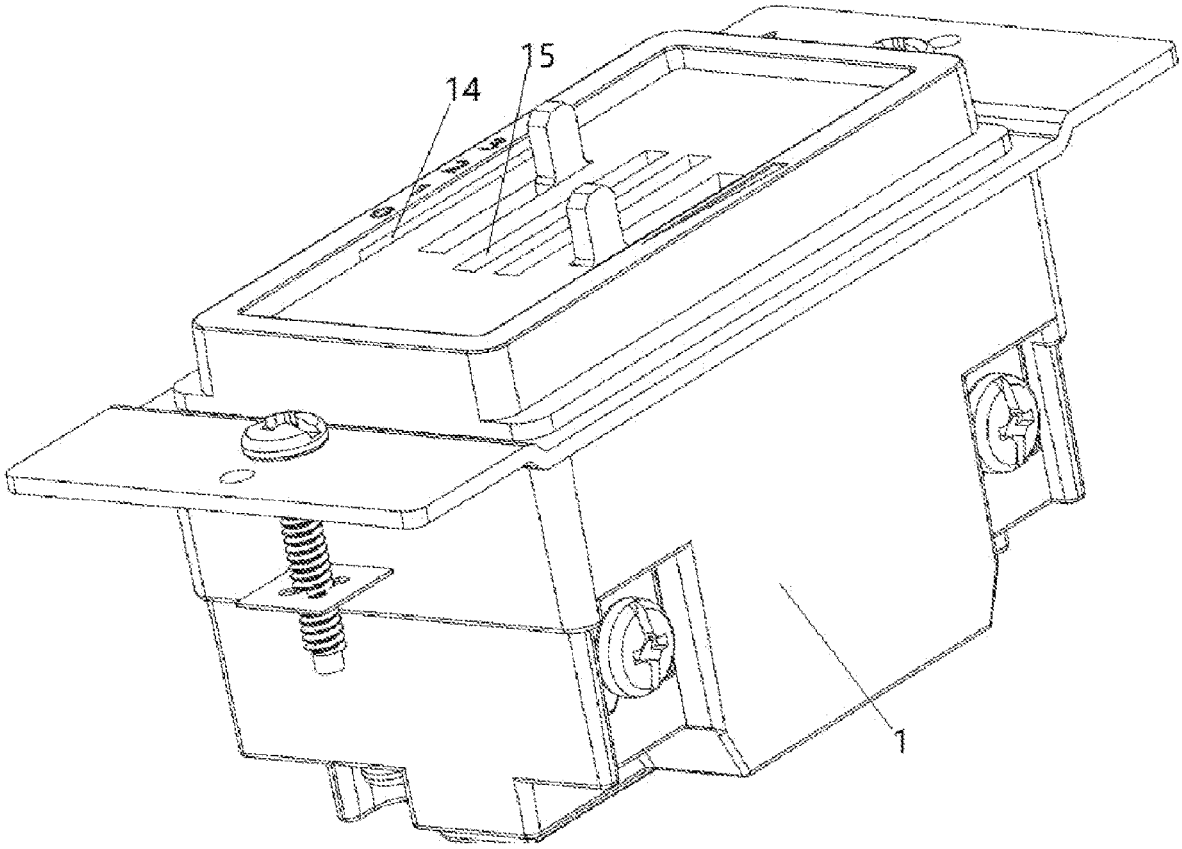
FIG. 11 is a perspective view of FIG. 1 with the push button removed.

Referring to FIG. 11, the inner side of housing 1 is provided with a sliding groove 14. A second elongated hole 15 is provided on the top surface, and the extension direction of the second elongated hole 15 is arranged in parallel with the moving direction of the push button 5 shown in FIG. 1.

The movable gear switching component is installed on housing 1 and includes a positioning component, a biasing component 2, a mounting seat 4, and a push button 5.

The positioning component, as shown in FIGS. 3-6, has a first position that is positioned and matched with the positioning groove 11 and a second position separated from the positioning groove 11. The positioning component is a roller 3, wherein in the first position, part of the roller 3 can extend into the positioning groove 11. A connecting shaft 31 is provided in the middle of the roller 3, and the connecting shaft 31 is a metal shaft. In the first position, both ends of the connecting shaft 31 are in contact with the corresponding static contacts 13 respectively, and side plates 32 are provided on either sides of the connecting shaft 31, and the side plates 32 are adjacent to the connecting shaft 31 to limit the left and right position of the connecting shaft 31.

Figure 5:
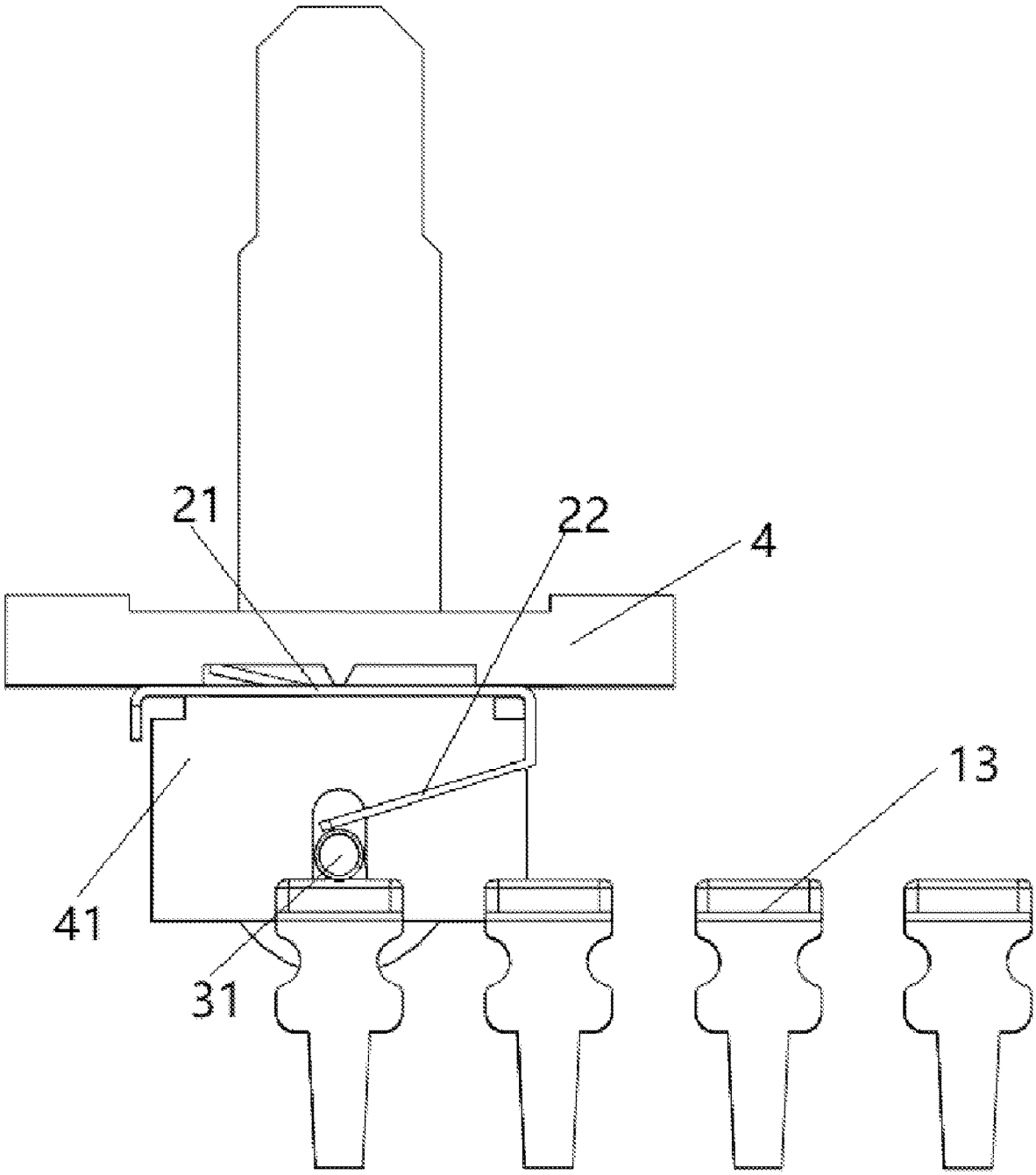
FIG. 5 is a front view of FIG. 2 with the side plate removed.
Figure 7:
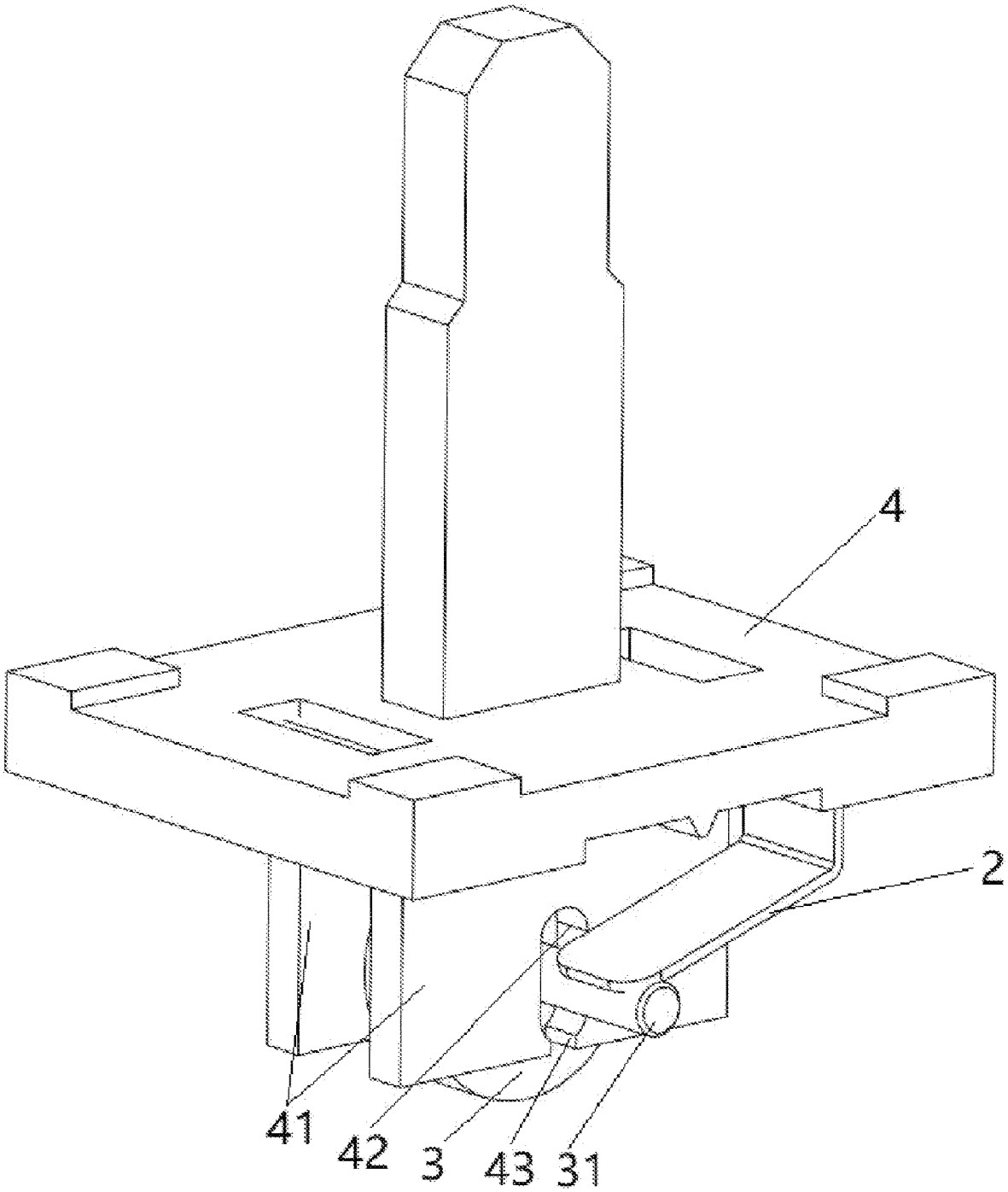
FIG. 7 is a perspective view of the mounting seat, biasing component, roller and connecting shaft after installed.
Figure 8:
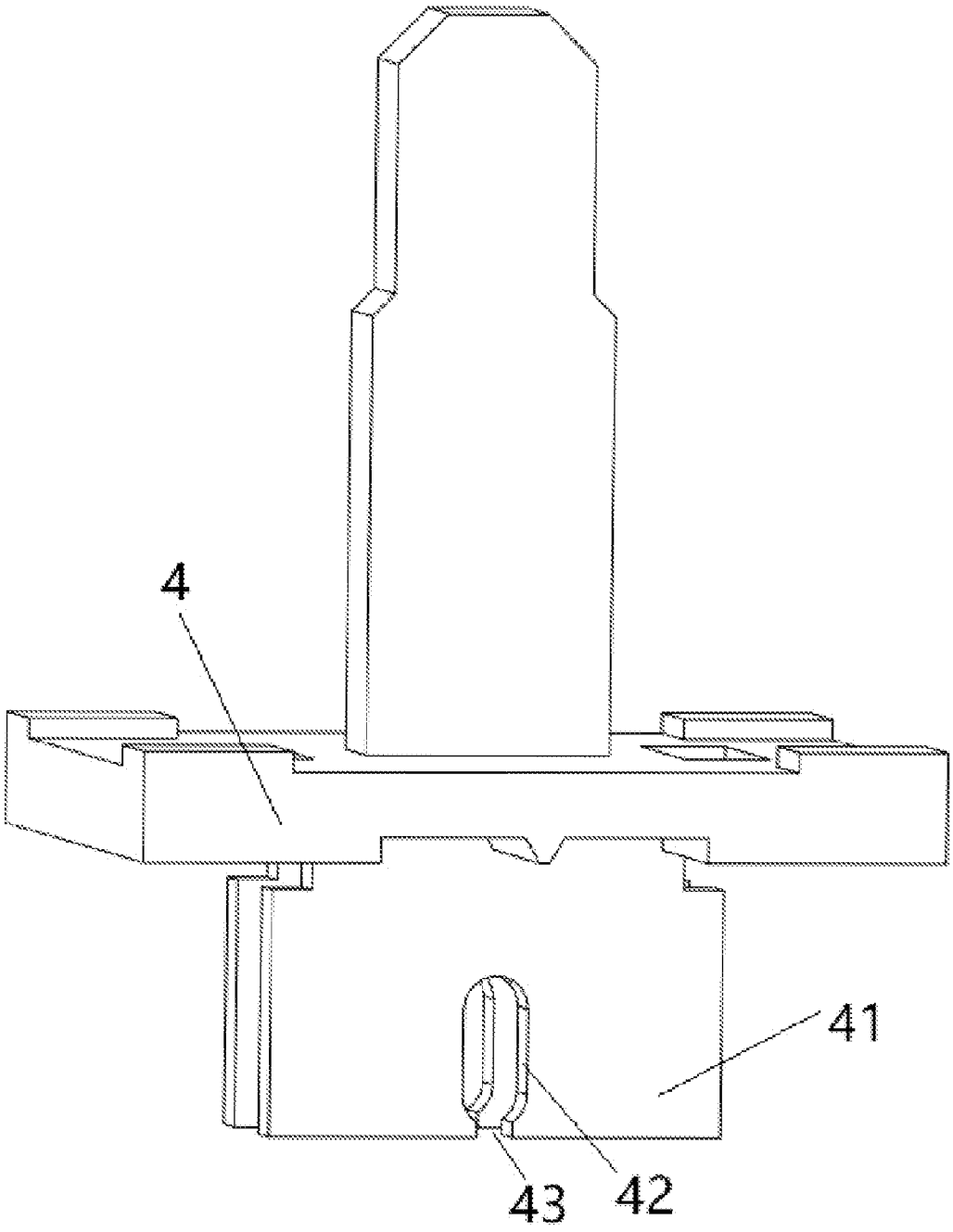
FIG. 8 is a perspective view of the mounting seat.
Figure 9:
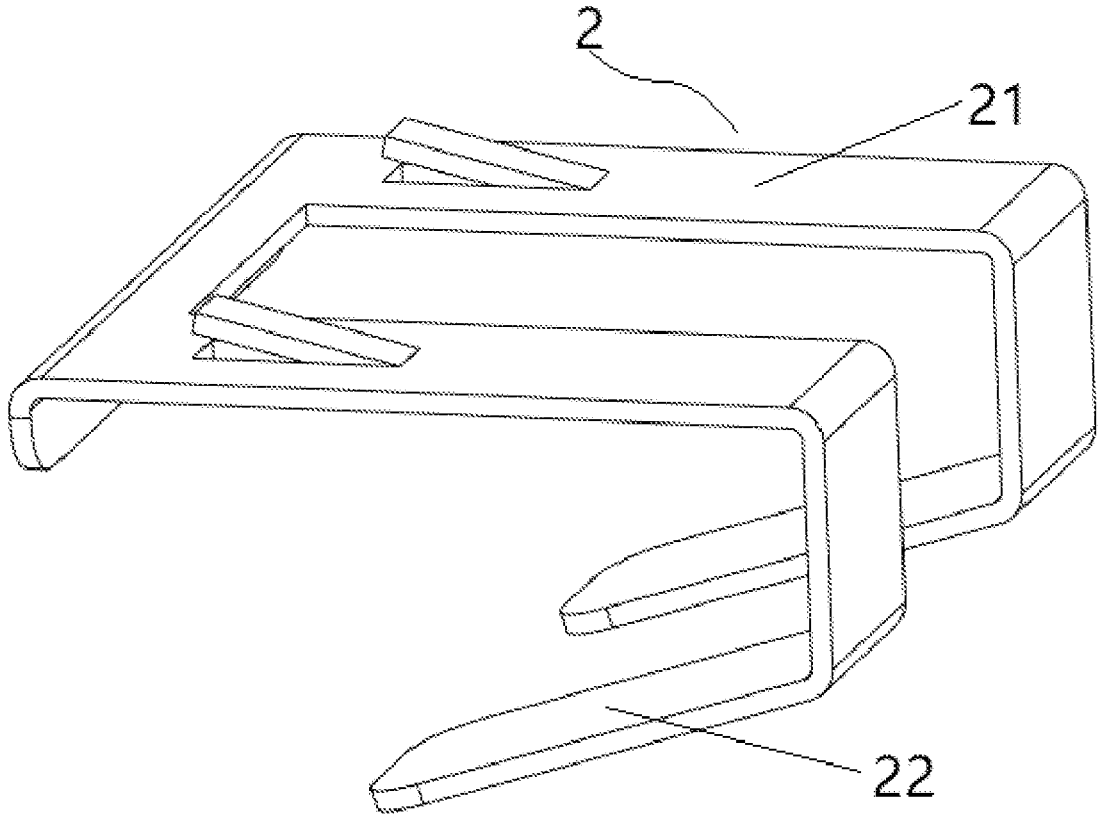
FIG. 9 is a perspective view of the biasing component.

The biasing component 2 is connected to the positioning component and applies a biasing force to the positioning component to move it toward the first position. As shown in FIGS. 5, 7, and 9, the biasing component 2 includes a main shrapnel 21 and the two elastic arms 22 are fixed on the mounting seat 4. Two elastic arms 22 are respectively arranged on both sides of the main shrapnel 21 and connect with its bend, the two elastic arms 22 are respectively adjacent to the two ends of the connecting shaft 31.

The mounting base 4, as shown in FIGS. 5-8, has two opposite mounting plates 41 arranged at the bottom for the rollers 3 to be installed between. The mounting plate 41 is provided with the connecting shaft 31 and extends out of the first elongated hole 42 that restricts the moving track of the connecting shaft 31. The first elongated hole 42 is provided with a second opening 43. The diameter of the second opening 43 is smaller than the diameter of the connecting shaft 31.

Figure 10:
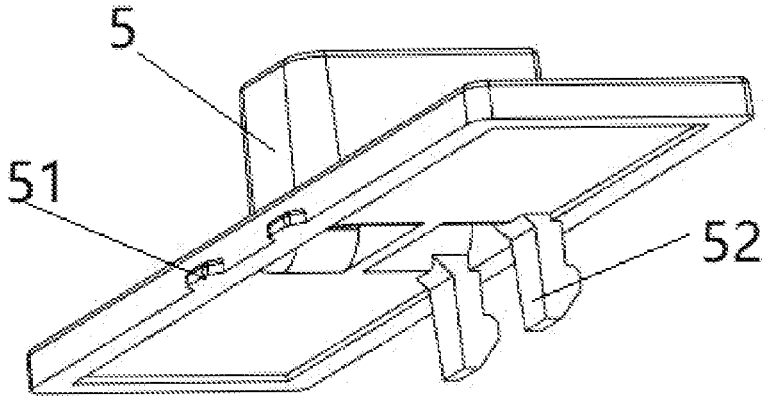
FIG. 10 is a perspective view of the push button.
Figure 12:
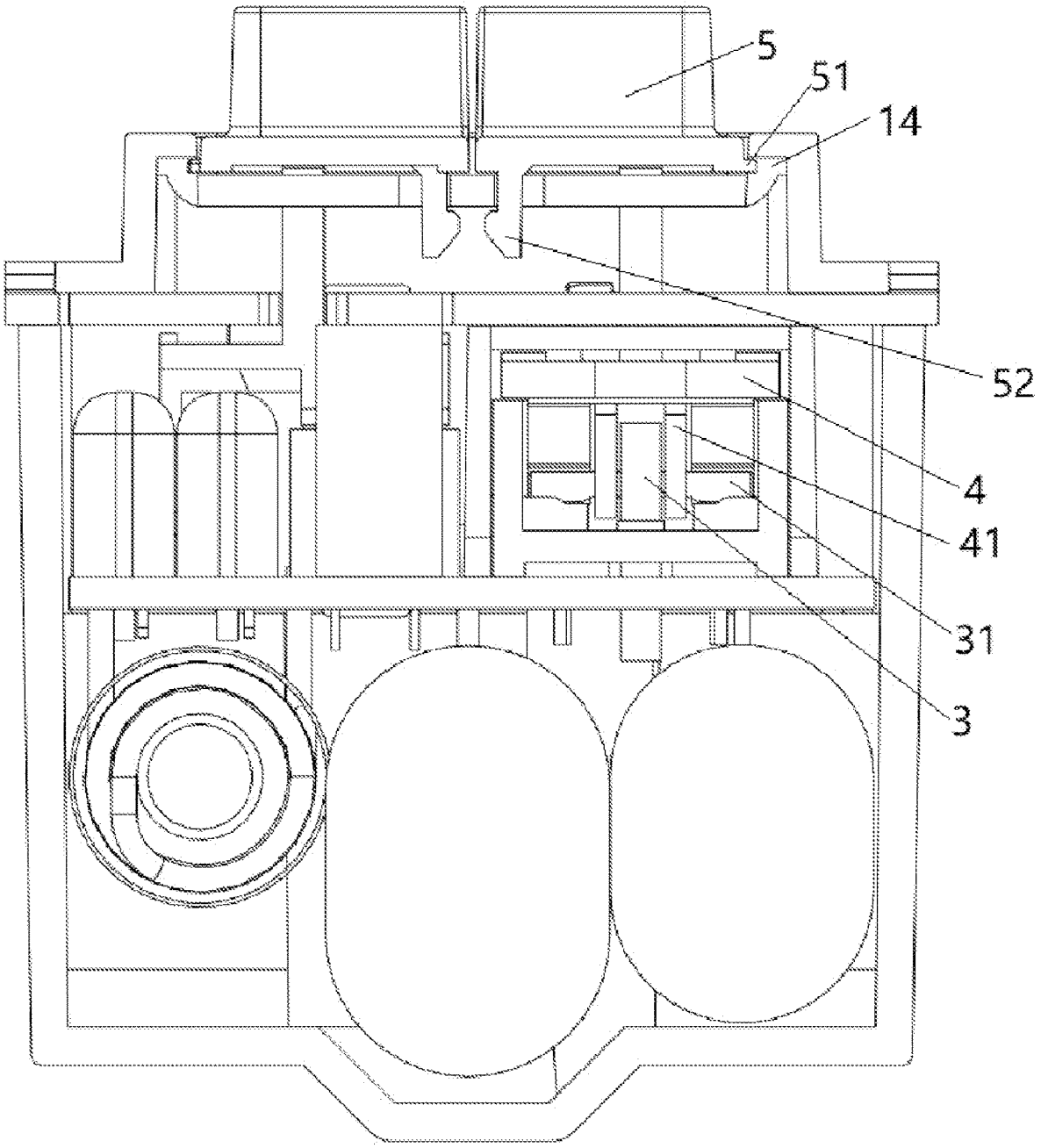
FIG. 12 is a cross-sectional view in another direction of FIG. 1.

The push button 5, as shown in FIGS. 2, 10, 12, is provided on the mounting seat 4 and can be linked with the mounting seat, and one side of the push button 5 is provided with second sliding blocks 51 connected by a slider to the sliding groove 14. Two elastic hooks 52 are provided on the other side of the push button 5, and the elastic hooks 52 can be hooked with the housing 1 after passing through the second elongated hole 15.

As an alternative embodiment, the contact surface between the first opening of the positioning groove 11 and the roller 3 is a curved surface.

As an alternative embodiment, the first elongated hole 42 is a closed hole.

The gear structure provided by the utility includes a plurality of positioning grooves 11 and a gear switching component. The plurality of positioning grooves 11 are arranged on the housing 1 at intervals; the movable gear switching component is installed on the housing 1. It includes a positioning component, and a biasing component 2 connected to the positioning component. The positioning component has a first position that is positioned and matched with the positioning groove 11 and a second position separated from the positioning groove 11. The biasing component 2 applies a biasing force to the positioning component to move it toward the first position. The gear structure mentioned above can ensure accurate gear positioning during the operation of the dimmer and speed control switch, and is not prone to incorrect operation, which is convenient for users, and the cooperated positioning groove 11 and positioning component simplify the structure.

Obviously, the foregoing embodiments are merely examples for clear description, and are not intended to limit implementation. For those of general technicians in this field, other changes or modifications in different forms can be made based on the description above. It is unnecessary and impossible to list all the modifications and forms here. The obvious changes or changes derived from this are still within the range of protection created by the aspects of the disclosed embodiments.

What is claimed is:

1. A gear assembly for a dimmer switch, the gear assembly comprising:

a plurality of positioning grooves arranged on a housing of the dimmer switch at intervals in a sequence;

a movable gear switching component installed on the housing, the movable gear switching component comprising:

a roller with a connecting shaft disposed in a middle of the roller, the roller having a first position that is positioned and matched with a positioning groove, wherein a part of the roller is configured to extend into the positioning groove in the first position and is separated from the positioning groove in a second position;

a biasing component, the biasing component configured to apply a biasing force to the roller to move it toward the first position; and a mounting seat with a bottom, the bottom of the mounting seat being provided with a first mounting plate and a second mounting plate, the first mounting plate and the second mounting plate being disposed on opposite sides of the roller;

the first mounting plate and the second mounting plate are respectively provided with an elongated hole that is configured to allow the connecting shaft to extend therethrough and limit a moving track of the connecting shaft; and a push button disposed on the mounting seat, the push button configured to be connected to the mounting seat by sliding into the housing through a sliding rail structure, wherein the sliding rail structure includes:

a sliding groove provided on an inner side of the housing; and at least one sliding block on one side of the push button that is configured to be connected and slide in the sliding groove;

wherein the push button is hooked and connected to the housing through an elastic hook structure, the elastic hook structure comprising:

an elongated hole provided on a top surface of the housing, an extending direction of the elongated hole being in parallel with the moving direction of the push button;

at least one elastic hook on an other side of the push button, and the at least one elastic hook configured to be hooked with the housing after passing through the elongated hole.

2. The gear structure according to claim 1, wherein a first opening of the positioning groove is provided with one of an inclined surface or a curved surface that is configured to contact the roller.

3. The gear structure according to claim 1, wherein the elongated hole of the first mounting plate and the elongated hole of the second mounting plate is provided with a second opening that extends through an end of a respective one of the first mounting plate and the second mounting plate that is opposite the bottom of the mounting seat, and a diameter of the second opening is smaller than a diameter of the connecting shaft.

4. The gear structure according to claim 3, wherein the housing is provided with a plurality of sets of static contact components arranged at intervals along a moving direction of the movable gear switching component, and a set of static contact components of the plurality of sets includes a first static contact and a second static contact;

wherein the first static contact is disposed on one side of the roller and the second static contact is disposed on an other side of the roller in the moving direction of the gear switching component, and the connecting shaft is a metal shaft; and in the first position, a first end of the connecting shaft is in contact with the first static contact and the second end is in contact with the second static contact.

5. The gear structure according to claim 4, further comprising a biasing component, wherein the biasing component comprises:

a main shrapnel member configured to be affixed to the bottom of the mounting seat, the main shrapnel member comprising a first elastic arm and a second elastic arm separately arranged on both sides of the main shrapnel member and connected together at one end, an other end of the first elastic arm and the second elastic arm are configured to abut against the first end and the second end of the connecting shaft, respectively.

6. A dimmer and speed control switch, comprising:

a housing with a plurality of positioning grooves; and a gear structure disposed within the housing, wherein the gear structure comprises:

a roller with a connecting shaft, a part of the roller being configured to extend into one of the plurality of positioning grooves in a first position, and in a second position the roller is separated from the one of the plurality of positioning grooves;

a biasing component, the biasing component configured to apply a biasing force to the roller to move it toward the first position; and a mounting seat with a bottom, the bottom of the mounting seat being provided with a first mounting plate and a second mounting plate, the first mounting plate and the second mounting plate being disposed on opposite sides of the roller with the connecting shaft extending through respective elongated holes in the first mounting plate and the second mounting plate; and a push button configured to be disposed on the mounting seat, wherein a sliding block disposed on one side of the push button is configured to engage and slide into a sliding groove on an inner side of the housing; and at least one elastic hook is disposed on an other side of the push button, the at least one elastic hook configured to be hooked with the housing after passing through an elongated hole provided on a top surface of the housing, an extending direction of the elongated hole being parallel with a moving direction of the push button.

7. The dimmer and speed control switch according to claim 6, wherein the biasing component comprises:

a main shrapnel member configured to be affixed to the bottom of the mounting seat, the main shrapnel member comprising a first elastic arm and a second elastic arm separately arranged on both sides of the main shrapnel member and connected together at one end, wherein an other end of the first elastic arm and the second elastic arm is configured to abut against respective ends of the connecting shaft.

8. The dimmer and speed control switch according to claim 6, where the elongated hole of the first mounting plate and the elongated hole of the second mounting plate is provided with a second opening, the diameter of the second opening being smaller than the diameter of the connecting shaft.

9. A gear assembly for a dimmer switch, the gear assembly comprising:

a roller with a connecting shaft, a part of the roller being configured to extend into a positioning groove of the dimmer switch in a first position, and in a second position the roller is separated from the positioning groove;

a biasing component, the biasing component configured to apply a biasing force to the roller to move it toward the first position; and a mounting seat with a bottom, the bottom of the mounting seat being provided with a first mounting plate and a second mounting plate, the first mounting plate and the second mounting plate being disposed on opposite sides of the roller with the connecting shaft extending through respective elongated holes in the first mounting plate and the second mounting plate; wherein the biasing component further comprises:

a main shrapnel member configured to be affixed to the bottom of the mounting seat, the main shrapnel member comprising a first elastic arm and a second elastic arm separately arranged on both sides of the main shrapnel member and connected together at one end, wherein an other end of the first elastic arm and the second elastic arm is configured to abut against respective ends of the connecting shaft.

10. The gear assembly according to claim 9, where the elongated hole of the first mounting plate and the elongated hole of the second mounting plate is provided with a second opening, the diameter of the second opening being smaller than the diameter of the connecting shaft.

11. The gear assembly according to claim 9, further comprising:

a push button configured to be disposed on the mounting seat, wherein a sliding block disposed on one side of the push button is configured to engage and slide into a sliding groove on an inner side of the housing.

12. The gear assembly according to claim 11, wherein at least one elastic hook is disposed on an other side of the push button, the at least one elastic hook configured to be hooked with the housing after passing through an elongated hole provided on a top surface of the housing, an extending direction of the elongated hole being parallel with a moving direction of the push button.

* * * * *